US011768008B2

(12) United States Patent
Yoon et al.

(10) Patent No.: US 11,768,008 B2
(45) Date of Patent: Sep. 26, 2023

(54) AIR CONDITIONER

(71) Applicant: LG ELECTRONICS INC., Seoul (KR)

(72) Inventors: Joonshik Yoon, Seoul (KR); Beomsoo Seo, Seoul (KR); Youngheon Kwon, Seoul (KR); Junho Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 287 days.

(21) Appl. No.: 17/184,902

(22) Filed: Feb. 25, 2021

(65) Prior Publication Data

US 2021/0262692 A1 Aug. 26, 2021

(30) Foreign Application Priority Data

Feb. 25, 2020 (KR) ..... 10-2020-0023199

(51) Int. Cl.

| | |
|---|---|
| ***F24F 11/89*** | (2018.01) |
| ***F24F 1/0063*** | (2019.01) |
| ***F24F 1/009*** | (2019.01) |
| ***F24F 13/32*** | (2006.01) |
| ***F24F 1/0067*** | (2019.01) |
| ***F24F 110/10*** | (2018.01) |

(52) U.S. Cl.

CPC ..... *F24F 11/89* (2018.01); *F24F 1/009* (2019.02); *F24F 1/0063* (2019.02); *F24F 1/0067* (2019.02); *F24F 13/32* (2013.01); *F24F 2110/10* (2018.01)

(58) Field of Classification Search

CPC ... G01K 1/14; G01K 1/08; F24F 11/89; F24F 1/0067; F24F 1/009; F24F 1/0063; F24F 13/32; F24F 2110/10

See application file for complete search history.

(56) References Cited

U.S. PATENT DOCUMENTS

2014/0334525 A1* 11/2014 Arensmeier ..... G01K 7/22 374/100
2020/0248929 A1* 8/2020 Hoyt ..... F24F 1/0053

FOREIGN PATENT DOCUMENTS

KR 10-2005-0041672 5/2005

* cited by examiner

*Primary Examiner* — Schyler S Sanks
(74) *Attorney, Agent, or Firm* — KED & ASSOCIATES, LLP

(57) ABSTRACT

An air conditioner may include a heat exchanger having a first cooling coil and a second cooling coil inclined toward each other, an inlet formed between a lower end of the first cooling coil and a lower end of the second cooling coil to allow air to pass through, an inside air duct through which air introduced to the inlet flows, an air supply duct through which the air passing through the heat exchanger flows, a fan causing air passing through the heat exchanger to flow, and a temperature sensor sensing a temperature of the air introduced into the heat exchanger. The heat exchanger includes a plate positioned between the first cooling coil and the second cooling coil. The plate may have a sensor insertion hole into which the temperature sensing device is inserted. By measuring the temperature of the air introduced into the heat exchanger, more accurate control information may be provided.

19 Claims, 6 Drawing Sheets

AIR CONDITIONER

CROSS-REFERENCE TO RELATED APPLICATION(S)

This application claims the priority benefit of Korean Patent Application No. 10-2020-0023199, filed in Korea on Feb. 25, 2020 in the Korean Intellectual Property Office, the disclosure of which is incorporated herein by reference.

BACKGROUND

1. Field

The present disclosure relates to an air conditioner.

2. Background

Air conditioners may supply air-conditioned air to an indoor space by exchanging heat between refrigerant and air flowing through an evaporator or condenser. Among different types of air conditioners, a unitary-type air conditioner connects the indoor space with a duct and supplies air-conditioned air through a heat exchanger to the indoor space.

An indoor unit of the unitary-type air conditioner may include an A-coil that serves as an evaporator and a gas furnace that may blow or guide gas and heat. The indoor unit of the unitary-type air conditioner may be installed in a basement or an attic, and air in an indoor space (hereinafter referred to as inside or indoor air) may be introduced through an inside or indoor air duct connected to the indoor unit and is air-conditioned. The air-conditioned air may be supplied to the indoor space through an air supply duct.

Korean Patent Laid-Open Publication No. 10-2005-0041672 (published on May 4, 2005) discloses a unitary-type air conditioner including a rectangular frame and an A-coil having a lower end supported at an upper portion of the frame. The A-coil may include a plurality of tubes through which refrigerant flows inside, and the air passing through the frame exchanges heat with the refrigerant of the A-coil to supply air-conditioned air indoors.

In the related art, a thermocouple measuring the indoor temperature and a thermostat transmitting a control signal to the air conditioner by comparing the indoor temperature and the set temperature may be used to adjust the indoor temperature. The thermocouple may be built into the thermostat and installed indoors to heat the indoor space. The thermostat may compare the temperature measured through the thermocouple with the set temperature and transmit a control signal to the unitary-type air conditioner.

However, when thermostats and unitary-type air conditioners are made by different manufacturers, it may be difficult to provide a wireless communication device capable of transmitting and receiving integrated precise control signals between products of different manufacturers. The thermostat may not be capable of transmitting, to the A-coil, a precise control signal based on the temperature, and may only be capable of transmitting an on/off control signal for a strong cooling and/or a weak cooling, and the indoor unit in the related art may not be precisely controlled based on the indoor temperature. In addition, in order to transmit the control signal to the indoor unit by wire, the communication line may have to be connected from the thermostat installed indoors to the indoor unit installed in the basement or attic through the wall, which may be difficult.

Korean Patent Laid-Open Publication No. 10-2005-0041672 discloses a frame.

The above reference is incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
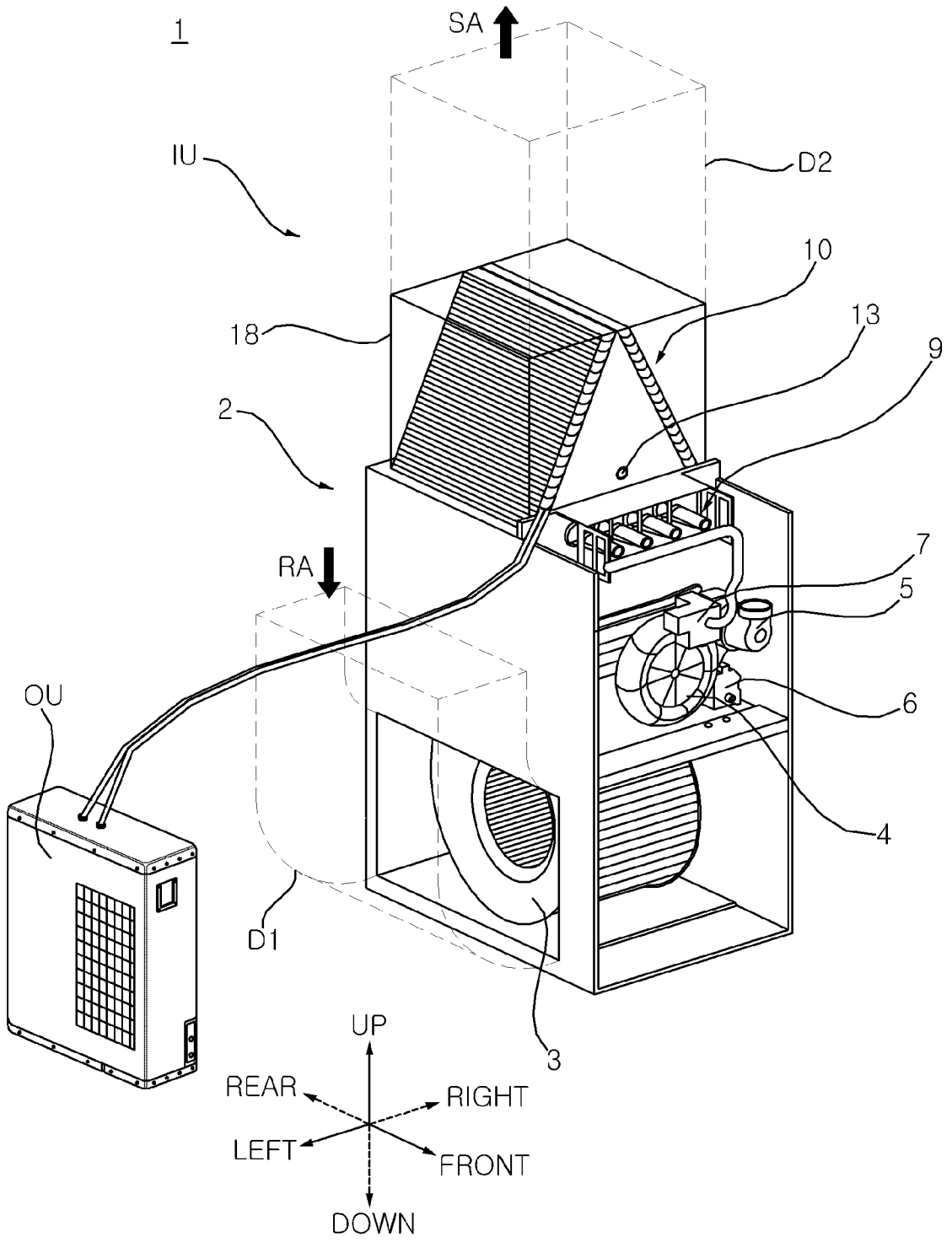
FIG. 1 is a perspective view of an air conditioner according to an embodiment.

Referring to FIG. 1, an air conditioner 1 according to an embodiment may refer to an indoor unit IU combined with a gas furnace 2 as a heating unit and a heat exchanger 10 as an indoor cooling unit. The gas furnace 2 may heat an interior or indoor space by supplying air heated by being heat exchanged with a flame generated during a combustion of fuel gas R and a high-temperature combustion gas P.

The indoor space may be cooled by using a blower fan 3, an inside air duct D1, and an air supply duct D2, which will be described later. Embodiments disclosed herein may be advantageous in terms of space utilization, installation cost reduction, and management and maintenance, compared to a case of having a separate cooling device.

In the air conditioner 1, a heating operation and a cooling operation may be performed by adjusting an operation or state of components or devices=described later. The air conditioner 1 may perform each of the above-described operations through a unified system, and thus may also be referred to as a unitary system air conditioner, an American large-capacity air conditioner, or a unitary-type air conditioner.

Since at least some of the components or devices of the air conditioner 1 may be commonly used for each of the above-described operations, some details or descriptions may be omitted.

<Configuration for Heating Operation of Air Conditioner 1>

As illustrated in FIG. 1, the gas furnace 2 may have a configuration for a heating operation, and may include a gas valve 7 to supply fuel gas R to a manifold, a burner 9 through which the fuel gas R discharged from the manifold passes, and a heat exchanger through which combustion gas P flows. The combustion gas P may be generated by the combustion of a mixture of the fuel gas R and the air passing through the burner 9.

The gas furnace 2 may include an induction fan 4 generating or guiding a flow of the combustion gas P to be discharged to an exhaust pipe 5 through the heat exchanger, the blower fan 3 to guide indoor air to the heat exchanger, and/or a condensate trap or collector 6 to collect condensate generated from the exhaust pipe 5 and to discharge the collected condensate to an outside.

As the fuel gas R is supplied through the gas valve 7, liquefied natural gas (LNG) may be used. The liquefied natural gas LNG may be obtained by cooling and liquefying natural gas or liquefied petroleum gas (LPG), which may be obtained by pressurizing gas obtained as a by-product of a petroleum refining process.

The fuel gas R may be supplied to the manifold or be blocked or prevented from the manifold depending on an opening and/or closing of the gas valve 7. An amount of the fuel gas R supplied to the manifold may be controlled by adjusting a degree of opening of the gas valve 7. The gas valve 7 may adjust a thermal power of the gas furnace 2.

The manifold may be connected to the gas valve 7 via a gas pipe. At least one discharge port to discharge the fuel gas R may be formed in the manifold. The fuel gas R supplied to the manifold may be introduced into a nozzle through the discharge port. The nozzle may inject the fuel gas R toward the burner 9, which will be described later.

The fuel gas R may be introduced into a venturi tube of the burner 9. The fuel gas R may pass through the venturi tube and be mixed with air to form a mixture. The mixture that has passed through the venturi tube of the burner 9 may be burned by spark ignition of an igniter installed on an upper side of the venturi tube of the burner 9. The mixture may be burned to generate a flame and high-temperature combustion gas P. In the heat exchanger, a flow path allowing a flow of the combustion gas P therethrough may be formed.

The gas furnace 2 may include a first heat exchanger and a second heat exchanger, which will be described later. Alternatively, the gas furnace 2 may include only a first heat exchanger.

The first heat exchanger may have one or a first end provided adjacent to the burner 9. Another or a second end opposite to the first end of the first heat exchanger may be coupled to a coupling box. The combustion gas P passing from the first end of the first heat exchanger to the second end may be transferred to the second heat exchanger through the coupling box.

One or a first end of the second heat exchanger may be connected to the coupling box. The combustion gas P that has passed through the first heat exchanger may be introduced into the first end of the second heat exchanger and may pass through the second heat exchanger.

The second heat exchanger may again exchange heat with the combustion gas P that has passed through the first heat exchanger and the air that passes or flows around the second heat exchanger. An efficiency of the gas furnace 2 may be improved by additionally using, through the second heat exchanger, the thermal energy of the combustion gas P that has passed through the first heat exchanger.

The combustion gas P passing through the second heat exchanger may be condensed through a process of transferring heat to the air passing or flowing around the second heat exchanger to generate condensate. Water or fluid vapor contained in the combustion gas P may be condensed and changed into condensate.

The gas furnace 2 provided with the first heat exchanger and the second heat exchanger may also be referred to as a condensing gas furnace. The generated condensate may be collected in a condensate collection unit or collector. Another or second end of the second heat exchanger opposite to the first end of the second heat exchanger may be connected to one or first side of the condensate collector.

The induction fan 4, which will be described later and may also be referred to as an induce, may be coupled to another or a second side of the condensate collection unit. Although the induction fan 4 is described as being coupled to the condensate collection unit, one of ordinary skill in the art will understand that the induction fan 4 may be indirectly coupled to the condensate collection unit. For example, the induction fan 4 may be coupled to a mounting plate to which the condensate collection unit is coupled.

An opening may be formed in the condensate collection unit. The second end of the second heat exchanger and the induction fan 4 may communicate with each other via the opening formed in the condensate collection unit. The combustion gas P that has passed through the second end of the second heat exchanger may escape to the induction fan 4 through the opening formed in the condensate collection unit, and then may be discharged to the outside of the gas furnace 2 through the exhaust pipe 5.

The condensate generated in the second heat exchanger may be discharged to the condensate trap 6 through the condensate collection unit and then discharged to the outside of the gas furnace 2 through the discharge port. The condensate trap 6 may be coupled to the second side of the condensate collection unit. The condensate trap 6 may collect and discharge not only the condensate water or fluid generated in the second heat exchanger, but also the condensate water or fluid generated in the exhaust pipe 5 connected to the induction fan 4. The condensate generated when the combustion gas P, which has not yet been condensed at the second end of the second heat exchanger, may be condensed while passing through the exhaust pipe 5, and may be also be collected by the condensate trap 6 and discharged to the outside of the gas furnace 2.

The induction fan 4 may communicate with the second end of the second heat exchanger via the opening formed in the condensate collection unit. One or a first end of the induction fan 4 may be coupled to the second side of the condensate collection unit, and another or a second end of the induction fan 4 may be coupled to the exhaust pipe 5.

The induction fan 4 may cause a flow of the combustion gas P to be discharged to the exhaust pipe 5 through the first heat exchanger, the coupling box, and the second heat exchanger. The induction fan 4 may be understood as an induced draft motor (IDM).

The blower fan 3, which may also be referred to as a blower, for the gas furnace 2 may be positioned under the gas furnace 2. The air supplied indoors may be moved from the bottom of the gas furnace 2 to the top by the blower fan 3. The blower fan 3 may be understood as an indoor blower motor (IBM). The blower fan 3 may guide or pass air around the heat exchanger.

The air passing around the heat exchanger by the blower fan 3 may be increased in temperature by receiving heat energy from the high-temperature combustion gas P through the heat exchanger. The indoor space may be heated by and supplied with the heated air.

The gas furnace 2 may include a case. The configurations or devices of the gas furnace 2 may be provided in the case. A lower opening may be formed on a side surface adjacent to the blower fan 3 in a lower portion of the case. The inside air duct D1 through which air introduced from the indoor space (hereinafter, inside or indoor air) RA passes may be installed or located in the lower opening.

At an upper portion of the case, an upper opening may be formed on a side adjacent to a heat exchanger 10 provided on an upper side of the heat exchanger of the gas furnace 2. The heat exchanger 10 may refer to the heat exchanger 10 used in a cooling operation, which is distinguished from the heat exchanger used in the gas furnace 2 for heating.

An air supply duct D2 through which air supplied indoors (hereinafter, supply air) SA passes may be installed or located in the upper opening. When the blower fan 3 is operated, air may be introduced from the interior through the inside air duct D1 as the inside air RA raises in temperature while passing through the heat exchanger, and may be supplied indoors through the air supply duct D2 as the supply air SA to heat the indoor space.

<Configuration for Cooling Operation of Air Conditioner 1>

As shown in FIG. 1, the air conditioner 1 may have a configuration for a cooling operation, in addition to the heating operation and may include the heat exchanger 10 and an outdoor unit OU, in which refrigerant C circulates. The heat exchanger 10 and the outdoor unit OU may include a refrigerant pipe 11 (FIG. 2) through which the refrigerant C flows. The outdoor unit OU may include a compressor, a condenser, and an expansion valve, and the heat exchanger 10 may be understood as an evaporator.

The cooling operation of the air conditioner 1 may be performed by cycling the processes of compression, condensation, expansion, and evaporation of the refrigerant C. The refrigerant C discharged from the compressor at a high temperature and a high pressure may discharge or radiate heat from the condenser to ambient air. The refrigerant C may be discharged at a low temperature and a low pressure through the expansion valve, may be evaporated into a gaseous state by absorbing heat from ambient air in the heat exchanger 10, and then may be introduced into the compressor again to complete the cooling operation cycle of the air conditioner 1.

Ambient air passing through the condenser may be outside or outdoor air existing around the outdoor unit OU, and the ambient air passing through the heat exchanger 10 may be the inside air RA introduced from the indoor space through the inside air duct D1. A flow of outside air passing through the condenser may be guided by an outdoor fan included in the outdoor unit OU, and the flow of the inside air RA passing through the heat exchanger 10 may be guided by the blower fan 3. When the blower fan 3 is operated, the air introduced from the indoor space through the inside air duct D1 as the inside air may decrease in temperature while passing through the heat exchanger 10, and may be supplied to the indoor space through the air supply duct D2 as the supply air SA to cool the indoor space.

Figure 2:
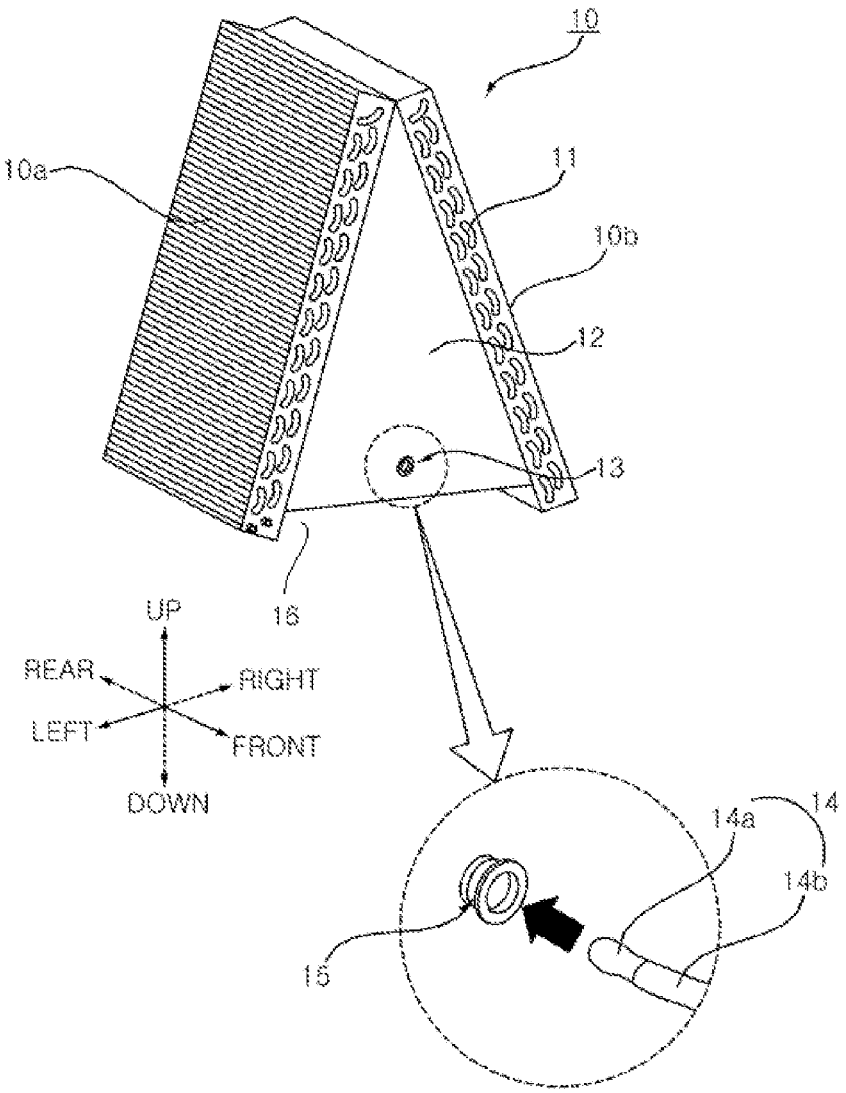
FIG. 2 is a perspective view of a heat exchanger according to FIG. 1.

Referring to FIGS. 1 and 2, the heat exchanger 10 may include a first cooling coil 10*a* and a second cooling coil 10*b* through which refrigerant flows. The first cooling coil 10*a* and the second cooling coil 10*b* may be provided inside a housing 18 forming the outer surface of the heat exchanger 10.

At least some of an upper surface of the first cooling coil 10*a* and an upper surface of the second cooling coil 10*b* may be in contact with each other, and a gap between the first cooling coil 10*a* and the second cooling coil 10*b* may widen in a downward direction. The first cooling coil 10*a* and the second cooling coil 10*b* may be inclined with respect to a flow direction of air.

An inlet surface through which air is introduced may be formed between a lower end of the first cooling coil 10*a* and a lower end of the second cooling coil 10*b*, and air may pass through the first cooling coil 10*a* and the second cooling coil 10*b* while flowing from a lower side of the heat exchanger 10 to an upper side of the heat exchanger 10. The first cooling coil 10*a* and the second cooling coil 10*b* may be inclined toward each other in an upward direction from the inlet surface of the heat exchanger 10 positioned on the side adjacent to the blower fan 3 to the discharge port positioned on the side adjacent to the air supply duct D2.

The heat exchanger 10 may have a shape similar to the alphabet letter "A" or upside-down V, and may be referred to as a so-called A-coil. An arrangement of the first cooling coil 10*a* and the second cooling coil 10*b* in an "A" shape when the flow of the inside air RA by the blower fan 3 is directed upward may be advantageous in improving heat transfer performance between the inside air RA and the first cooling coil 10*a* and the second cooling coil 10*b*.

A plate 12 may be provided between the first cooling coil 10*a* and the second cooling coil 10*b*. The plate 12 may have an "A" shape and surface which extends in the vertical and right-left (as shown in FIG. 2) directions. The plate 12 may support the first cooling coil 10*a* and the second cooling coil 10*b* by contacting an inner surface of the first cooling coil 10*a* and an inner surface of the second cooling coil 10*b*. The plate 12 may guide a flow of air when the air flows upward through the blower fan 3 and passes through the cooling coil 10*b*.

The heat exchanger 10 may further include a temperature sensing device or a temperature sensor 14 to sense a temperature of air introduced into the heat exchanger 10. The plate 12 may be formed with a sensor insertion hole 13 into which the temperature sensing device 14 is inserted. The temperature sensing device 14 may measure the temperature of the inside air RA introduced into an inlet surface of the heat exchanger 10 by being inserted into the heat exchanger 10 through the sensor insertion hole 13 formed in the plate 12.

The temperature sensing device 14 may use, for example, a thermocouple or a resistance temperature detector (RTD), which may be contact-type temperature sensors, to measure the temperature by contacting flowing air. The temperature sensing device 14 may be defined as a sensing unit or sensor 14*a* formed at an end and sensing a temperature and a body unit or body 14*b* extending from the sensing unit 14*a*. The sensor 14*a* may also be referred to as a sensor head or probe. The temperature sensing device 14 may have a shape that is elongated in a first (e.g., front-rear direction) to measure the temperature of air deep inside of the heat exchanger 10.

The temperature sensing device 14 may be connected to a control unit or controller configured to control the air conditioner 1. The controller may receive information about temperature of the inside air RA sensed by the temperature sensing device 14 and transmit a control signal to the compressor or expansion valve of the air conditioner 1 through wired or wireless communication.

In the related art, a thermocouple may be installed indoors to measure the indoor temperature, and based on a measurement, a thermostat may transmits an ON/OFF control signal to an indoor unit IU installed underground. The indoor temperature may not be precisely controlled. In order to solve the above problem, embodiments disclosed herein may control a temperature and/or flow rate of refrigerant by measuring the temperature of the inside air RA immediately before passing through the cooling coils 10*a* and 10*b*, which may be advantageous in precisely controlling the indoor temperature. In addition, since the controller to which the temperature sensing device 14 is connected may be connected to the compressor or the expansion valve in a wired manner, installation convenience may be increased compared to a thermostat installed indoors being connected to the indoor unit IU installed underground by wired communication.

If the temperature sensing device 14 comes into contact with or close to the first cooling coil 10*a* or the second cooling coil 10*b*, a sensing may be affected by natural convection from the cooling coils 10*a* and 10*b*, and thus, there may be some errors. Accordingly, the sensor insertion hole 13 and the temperature sensing device 14 may be spaced apart from the first cooling coil 10*a* and the second cooling coil 10*b* by a predetermined distance or as much as possible. The sensor insertion hole 13 may be formed adjacent on the lower portion of the plate 12 to be spaced apart from the first cooling coil 10*a* and the second cooling coil 10*b*. The sensor insertion hole 13 may be positioned to be spaced equally apart from the lower portion of the first cooling coil 10*a* and the lower portion of the second cooling coil 10*b* in the right-left direction.

The heat exchanger 10 may further include a first bushing 15 provided in the sensor insertion hole 13 and into which the temperature sensing device 14 is inserted. The first bushing 15 may come into close contact with an outer circumferential surface of the temperature sensing device 14.

The first bushing 15 may be made of a rubber or elastic material and may be a kind of shock absorber blocking vibration. The first bushing 15 may be fixed in the sensor insertion hole 13 of the plate 12 so that the temperature sensing device 14 may not be shaken or separated from the heat exchanger 10 as air flows upward in the heat exchanger 10.

Hereinafter, cases 20 and 30 shown in FIGS. 3 through 6, may be described based on a Cartesian coordinate system (clarified by the arrows in FIGS. 3 through 6). Cases 20 and 30 may respectively have upper surfaces or walls 21 and 31 facing upward, lower surfaces or walls 22 and 32 facing downward, side surfaces or walls 23 and 33 of the cases 20 and 30 facing left and right, front surfaces or walls 24 and 34 facing forward, and rear surfaces or walls 25 and 35 facing rearward. The cases 20 and 30 may alternatively be referred to as a temperature sensor support or a sensor support.

Figure 3:
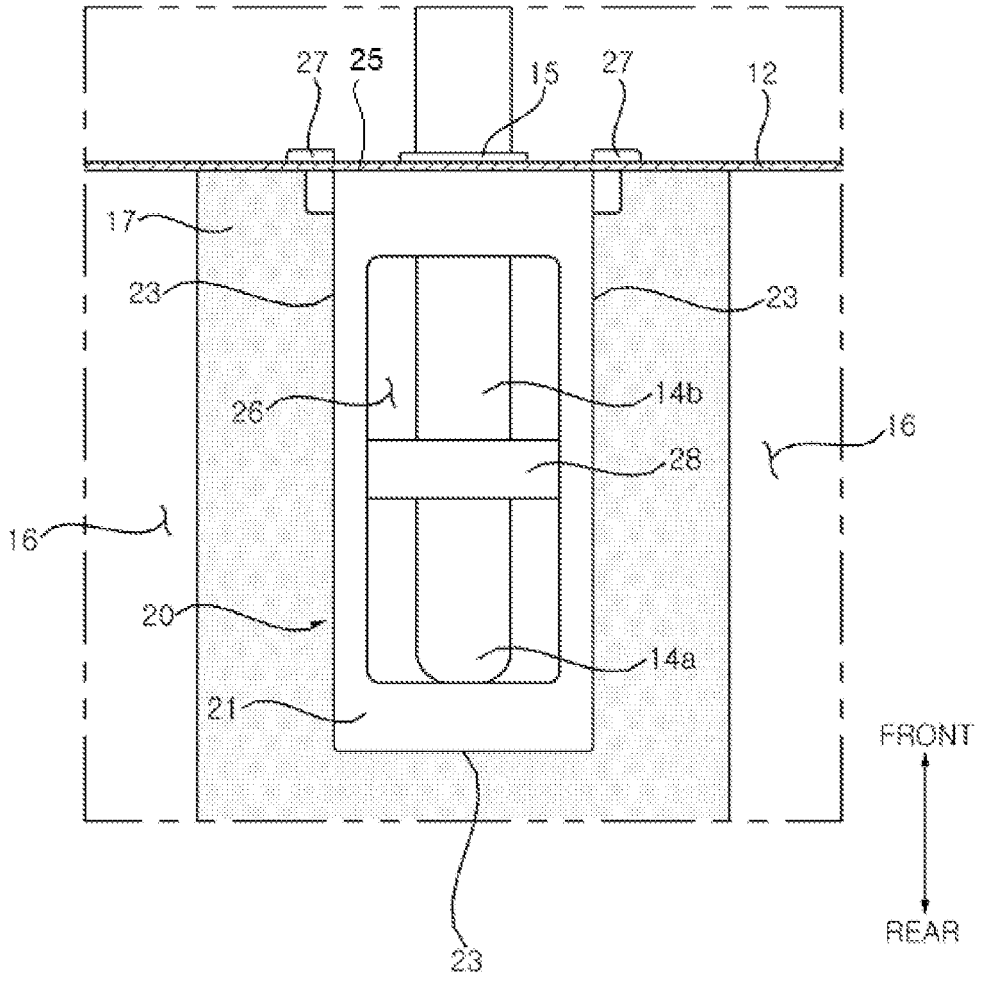
FIG. 3 is a diagram viewed from above inside a heat exchanger according to an embodiment.
Figure 4:
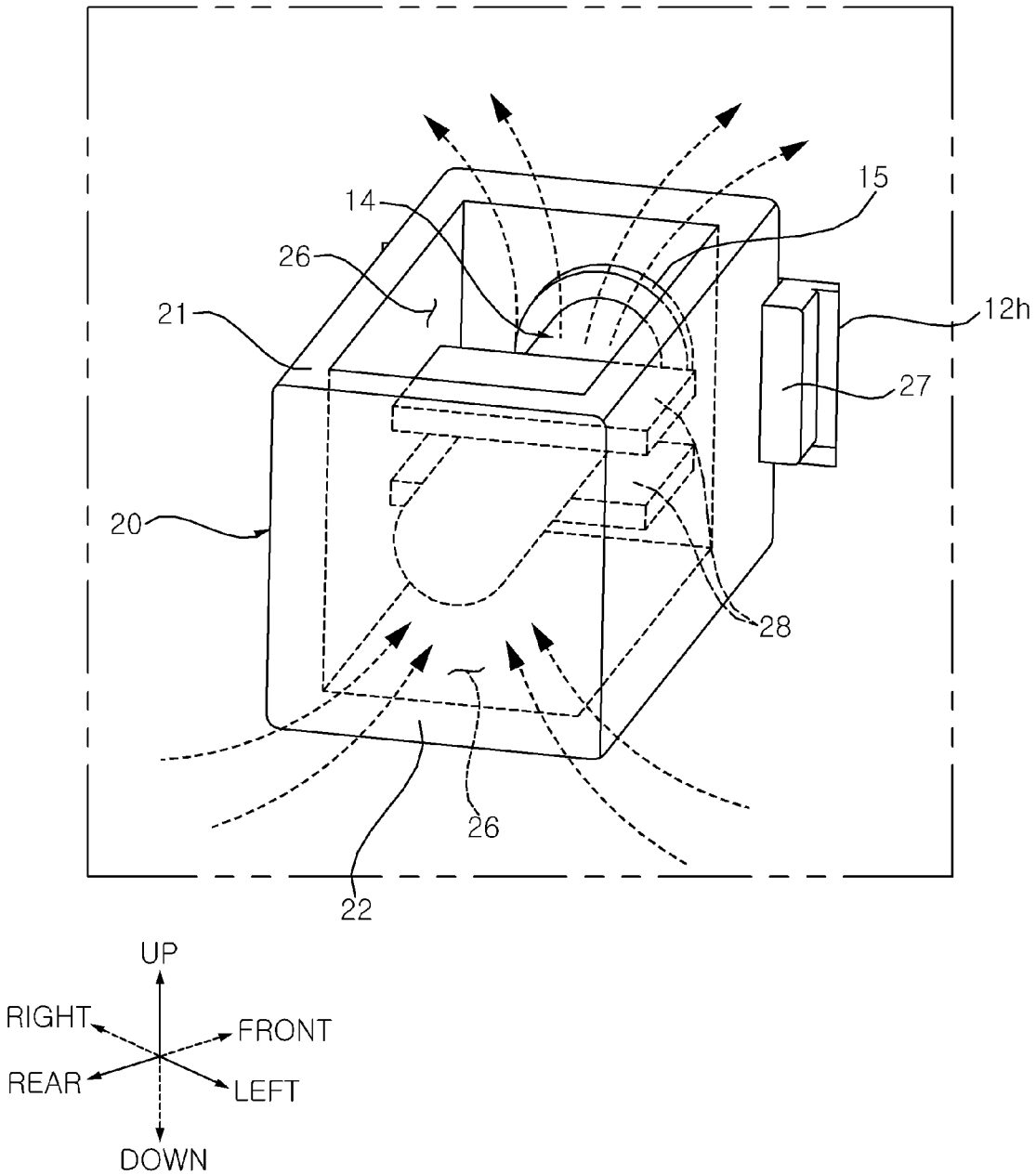
FIG. 4 is a perspective view of the inside of the heat exchanger according to an embodiment.

Referring to FIGS. 2-4, the heat exchanger 10 may include a case 20 into which at least a portion of the temperature sensing device 14 is introduced. The case 20 may be formed with an inlet formed in the rear surface 25 through which the temperature sensing device 14 is introduced. The case 20 may be provided between a lower portion of the first cooling coil 10*a* and a lower portion of the second cooling coil 10*b*. The case 20 may have a through hole or passage 26 formed in a vertical direction through which air flows. The temperature sensing device 14 may be inserted into the rear surface of the case 20, and at least a portion of the temperature sensing device 14 may be provided within the through hole 26.

When the inside air RA is introduced through the inlet surface 16 formed at the lower end of the heat exchanger 10, some air may pass through the through hole 26 of the case 20 from a lower side to an upper side before passing through the first cooling coil 10*a* and the second cooling coil 10*b*. The temperature sensing device 14 provided in the through hole 26 may measure the temperature of the air passing through the through hole 26. At least the sensor 14*a* of the temperature sensing device 14 may be provided in the through hole 26.

Except for the upper surface 21 and the lower surface 22 of the case 20 forming the through hole 26 and the rear surface 25 forming the inlet, other surfaces (e.g., the side surfaces 23 and the front surface 24) of the case 20 may be a closed surface. The side surfaces 23 of the case 30 and the front surface 24 of the case 20 may block or impede air. An effect of natural convection on the temperature sensing device 14 by the refrigerant flowing in the first cooling coil 10*a* and the second cooling coil 10*b* may be reduced or minimized, and the temperature sensing device 14 may accurately measure the temperature of the inside air RA passing through the through hole 26. The case 20 may be made of an insulating material to reduce or minimize the effect of natural convection.

An inner peripheral or circumferential surface of the case 20 defining the through hole 26 may be formed larger than an outer peripheral or circumferential surface of the temperature sensing device 14. The sensing unit 14*a* of the temperature sensing device 14 may be provided inside the through hole 26, and the inner surface of the case 20 defining the through hole 26 may be formed to be larger or have a greater cross-sectional area than an outer peripheral or circumferential surface of the sensing unit 14*a*. At least a portion of the sensor 14*a* of the temperature sensing device 14 may be spaced apart from the inner surface of the case 20 defining the through hole 26. The sensor 14*a* of the temperature sensing device 14 may be spaced apart from the inner surface of the case 20 defining the through hole 26.

When the air passes through the through hole 26, positions of the case 20 and the temperature sensing device 14 may be changed by a force of the flowing air. The case 20 may have a rear surface 25 extending to the plate 12 and fixed to the plate 12 to secure a position of the case 20. The inlet formed on the rear surface 25 of the case 20 may be provided at a position corresponding to the sensor insertion hole 13 formed in the plate 12 and the first bushing 15. Unlike the case 30 according to another embodiment of the present disclosure, which will be described later, the case 20 may be coupled to the plate 12 to extend in the rear direction of the heat exchanger 10, which may render insertion of the temperature sensing device 14 through the sensor insertion hole 13 convenient.

The rear surface 25 of the case 20 may be fixed by being integrally formed with the plate 12, or may be fixed by being detachably coupled. For example, as shown in FIGS. 3 and 4, the plate 12 may include hook insertion holes 12*h* formed at a position around or near the sensor insertion hole 13, and a rear side or end of the case 20 may include hooks 27 to fix to the hook insertion hole 12*h* and fasten the case 20 to the plate 12. The hooks 27 may be formed on rear ends of the side surfaces 23 of the case 20, and the hook insertion holes 12*h* may be formed on the plate 12 at positions corresponding to the hooks 27.

If the case 20 is fixed to the plate 12, the temperature sensing device 14 may be exposed to an outside of the case 20 due to an influence of the air flow. When the sensing unit 14*a* of the temperature sensing device 14 is exposed to the outside of the case 20, an error in temperature sensing may occur. To prevent the temperature sensing device 14 from being separated to the outside of the case 20, the case 20 may include a supporter 28 (e.g., a pair of frames or plates) supporting upper and lower portions of the temperature sensing device 14. The upper and lower portions of the temperature sensing device 14 may refer to portions of the temperature sensing device 14 facing upward and downward, respectively, in the up-down direction axis based on the Cartesian coordinate system of FIG. 4.

The supporter 28 may be a member or frame extending from one inner surface (e.g., a right inner side surface) of the case 20 to another inner surface (e.g., a left inner side surface). The supporter 28 may not interfere with the flow of air flowing toward the sensor 14*a* by supporting or contacting the body 14*b* of the temperature sensing device 14 instead of directly supporting or contacting the sensor 14*a*.

Figure 5:
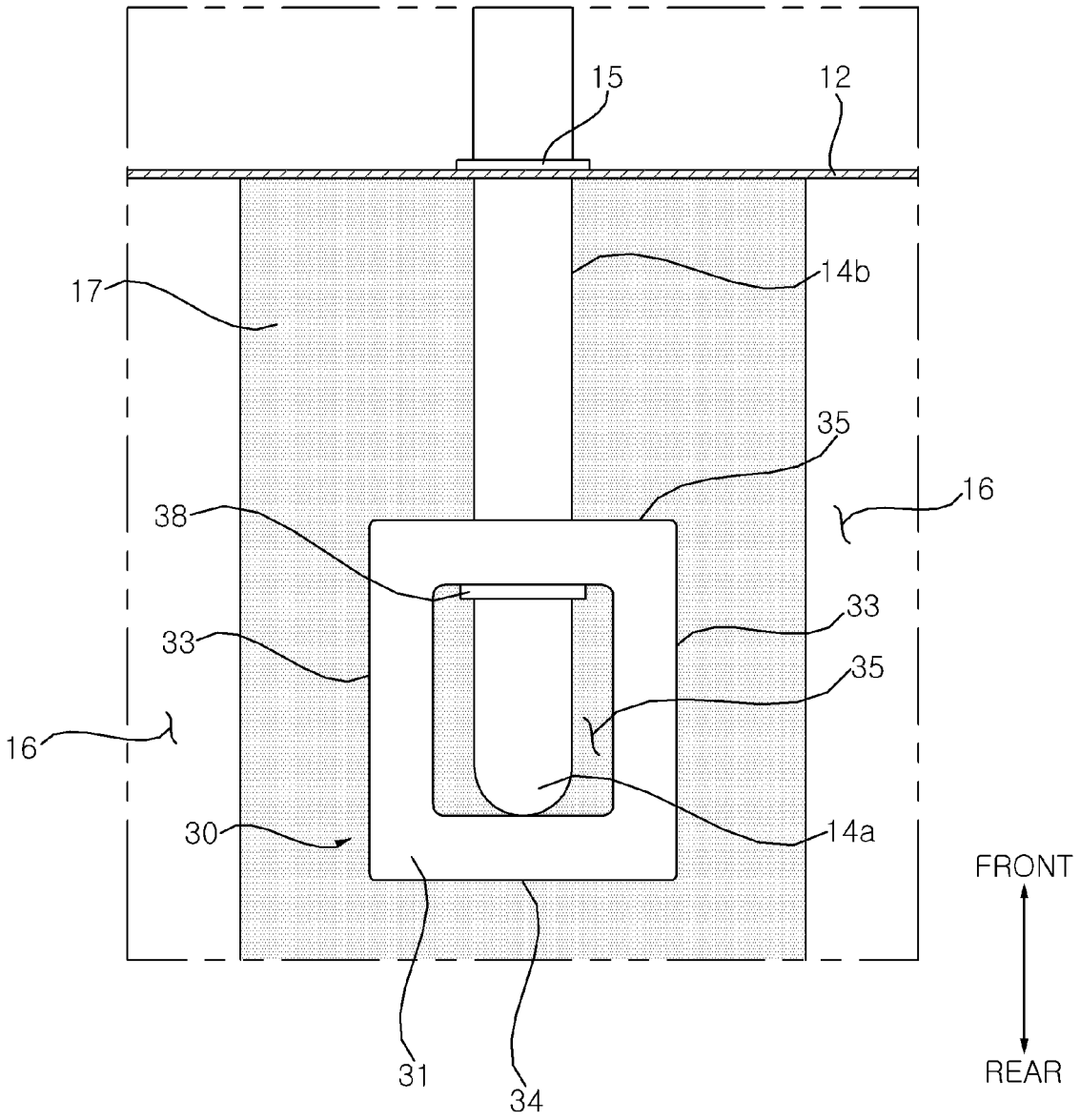
FIG. 5 is a diagram viewed from above inside a heat exchanger according to another embodiment.
Figure 6:
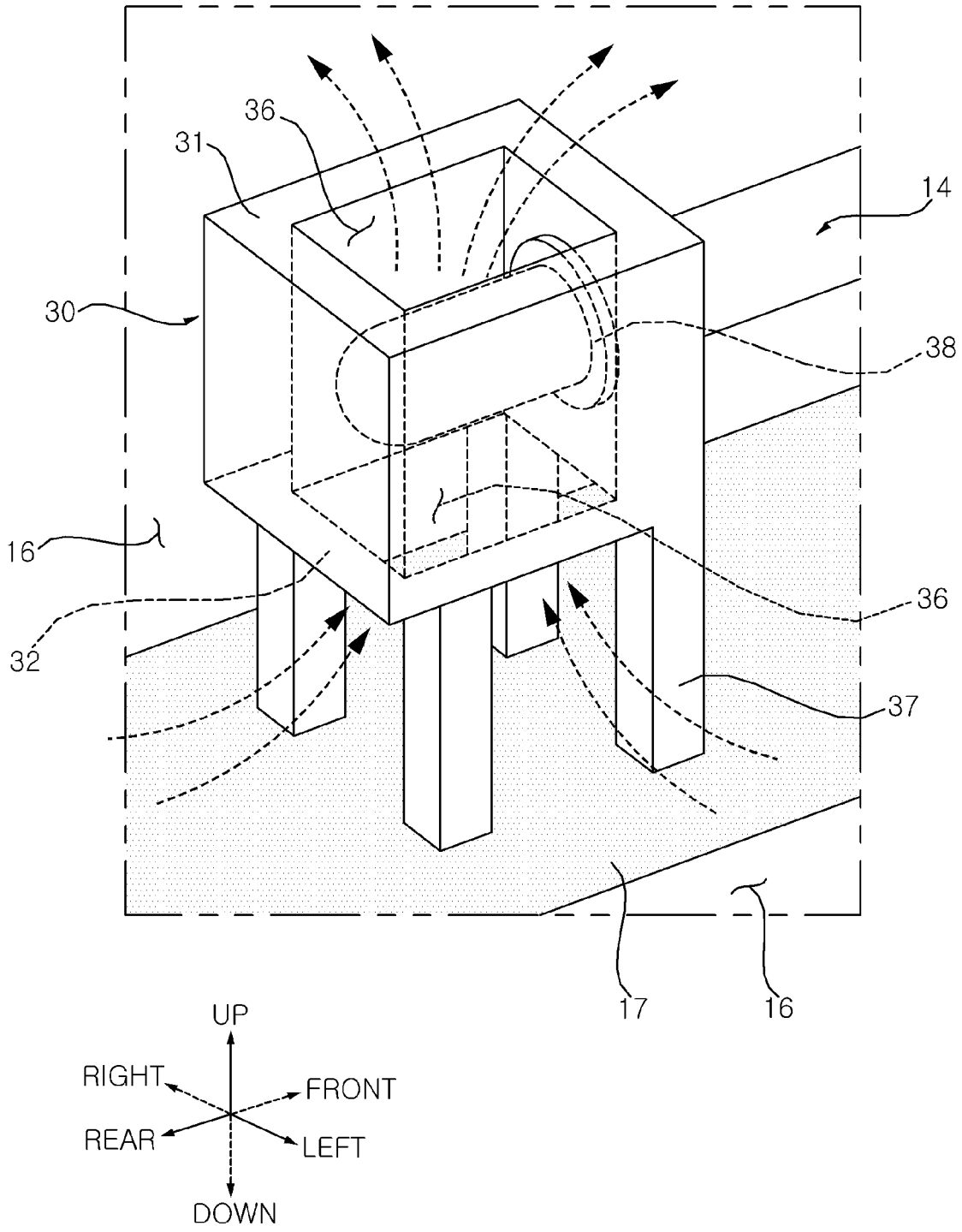
FIG. 6 is a perspective view of the inside of the heat exchanger according to another embodiment.

A heat exchanger 10 according to another embodiment of the present disclosure will be described with reference to FIGS. 2, 5, and 6. Referring to FIGS. 2, 5, and 6, a case 30 may be similar to the case 20 described with reference to FIGS. 2-4, and similar details may be omitted. The rear surface 35 of the case 30 may be formed with an inlet through which at least a portion of the temperature sensing device 14 is inserted. The case 30 may be provided between a lower portion of the first cooling coil 10*a* and a lower portion of the second cooling coil 10*b*. The case 30 may have a through hole or passage 36 formed in a vertical direction through which air flows. The temperature sensing device 14 may pass through the sensor insertion hole 13 to be provided inside of the case 30.

When the inside air RA is introduced through an inlet surface 16 formed at the lower end of the heat exchanger 10, some air before passing through the first cooling coil 10*a* and the second cooling coil 10*b* may pass through the through hole 36 of the case 30 from a lower side to an upper side. The temperature sensing device 14 may measure a temperature of the air passing through the through hole 36, an at least the sensor 14*a*, if not a portion of the body 14*b*, of the temperature sensing device 14 may be provided in the through hole 36.

The side surfaces 33 of the case 30 and the front surface 34 of the case 20 may be closed to block air. In the case 30, an effect of natural convection on the temperature sensing device 14 by the refrigerant flowing in the first cooling coil 10*a* and the second cooling coil 10*b* may be reduced or minimized so that the temperature of the inside air RA passing through the through hole 36 may be more accurately measured. The case 30 may be made of an insulating material to reduce or minimize the effect of natural convection.

An inner peripheral or circumferential surface of the case 30 defining the through hole 36 may be formed larger than an outer peripheral or circumferential surface of the temperature sensing device 14. The sensor 14*a* of the temperature sensing device 14 may be provided in the through hole 36, and the inner surface of the case 30 may be formed to be larger or define a greater cross-sectional area than that of outer surface of the sensing unit. At least a portion of the sensor 14*a* of the temperature sensing device 14 may be spaced apart from the inner surface of the case 30. The sensor 14*a* of the temperature sensing device 14 may be spaced apart from sides of the inner surface of the case 30 that define the through hole 36.

The heat exchanger 10 may include a bracket 17 that separates the inlet surface 16 into a portion or side adjacent to the first cooling coil 10*a* and a portion or side adjacent to the second cooling coil 10*b*. A rectangular frame may be formed under the heat exchanger 10 to support lower ends of the first cooling coil 10*a*, the second cooling coil 10*b*, and the plate 12, and the bracket 17 may be coupled to the inner surface of the frame. The bracket 17 may be provided between (e.g., at an intermediate position or midpoint between) the lower side of the first cooling coil 10*a* and the lower side of the second cooling coil 10*b*.

The case 30 may be formed with a leg 37 extending from the lower surface 32 of the case 30. The legs 37 may be extended from the lower surface 32 of the case to the bracket 17. The leg 37 may contact the bracket 17 to support a lower portion of the case 30 and prevent the case 30 and the temperature sensing device 14 from being unstably shaken due to the flow of the air passing through the through hole 36. The leg 37 may be fixed (e.g., coupled, fusion bonded, welded, or fastened) to the bracket 17.

A plurality of legs 37 may be formed to be spaced apart from each other on the lower end of the case 30, and air may flow between the plurality of the legs 37. As illustrated in FIG. 6, the lower surface 32 of the case 30 may have a square shape, the through hole 36 may be formed through a center of the lower surface 32, and the plurality of legs 37 may protrude downward from each corner of the lower surface 32. The plurality of legs 37 may contact the bracket 17 to form spaced gaps between the plurality of legs 37. The inside air RA may be introduced into the heat exchanger 10 from the inlet surface 16, and pass between the spaced gaps formed by the plurality of legs 37 and through the through hole 36 in sequence.

The case 30 may include a second bushing 38 that provided in the rear surface 35 of the case 30 and into which the temperature sensing device 14. The second bushing 38 contact the outer circumferential surface of the temperature sensing device 14. The second bushing 38 may prevent the temperature sensing device 14 from being separated from the case 30. The first and second bushings 15 and 38 may alternatively be referred to as first and second sleeves or gaskets.

In the above, it will be apparent that, although the embodiments of the present disclosure have been illustrated and described above, the present disclosure is not limited to the above-described specific embodiments, and various modifications can be made by those skilled in the art without departing from the gist of the present disclosure as claimed in the appended claims. The modifications should not be understood separately from the technical spirit or prospect of the present disclosure.

Embodiments disclosed herein may be advantageous in having more accurate control information by measuring the temperature of the air flowing into the heat exchanger. Embodiments disclosed herein may be capable of reducing or minimizing an effect of natural convection from the heat exchanger through a case where the temperature sensing device is inserted.

Embodiments disclosed herein may to solve the problems of the related art. Embodiments disclosed herein may be implemented as an air conditioner capable of measuring the temperature to precisely control an indoor unit according to the indoor temperature. Embodiments disclosed herein may provide an air conditioner capable of reducing or minimizing an influence of natural convection from a heat exchanger when measuring the inside air through a temperature sensing device.

The problems to be solved in the present disclosure are not limited to the above-mentioned problems, and other problems not mentioned will be apparent to those skilled in the art upon reading the following description.

Embodiments disclosed herein may be implemented as air conditioner including a heat exchanger having a first cooling coil and a second cooling coil through which refrigerant flows and which are arranged to be inclined to each other. The heat exchanger may have an inlet surface of air formed between a lower end of the first cooling coil and a lower end of the second cooling coil to allow air to pass through, an inside air duct through which air introduced to the inlet surface flows, an air supply duct through which the air passing through the heat exchanger flows, a blower fan causing the air passing through the heat exchanger to flow, and a temperature sensing device sensing a temperature of the air introduced into the heat exchanger.

The heat exchanger may include a plate positioned between the first cooling coil and the second cooling coil. A sensor insertion hole may be formed in the plate, and a temperature sensing device may be inserted through the sensor insertion hole. The sensor insertion hole may be formed on a lower portion of the plate to be spaced apart from the first cooling coil and the second cooling coil.

The heat exchanger may further include a first bushing or sleeve which is provided in the sensor insertion hole and into which the temperature sensing device is inserted to come into close contact with an outer circumferential surface of the temperature sensing device. The air conditioner may further include a case provided between a lower portion of the first cooling coil and a lower portion of the second cooling coil. A through hole may be formed in a vertical direction in which air flows, and the temperature sensing device may be inserted into a rear surface of the case and provided between the through hole.

The case may be fixed to the plate by the rear surface extending to extend to the plate. The plate may be formed with a hook insertion hole around the sensor insertion hole, and the case may be formed with a hook fixed to the hook insertion hole at a rear end thereof. The case may be provided with the through hole, and may include a supporter supporting an upper portion and a lower portion of the temperature sensing device.

A bracket may be provided under the heat exchanger and separate the inlet surface into a portion adjacent to the first cooling coil and a portion adjacent to the second cooling coil. The case may be formed with a leg extending from a lower surface of the case to the bracket.

The leg may be formed to be spaced apart from each other on the lower surface of the case, and air may flow between the plurality of the legs. The case may include a second bushing that is provided in the rear surface of the case and into which the temperature sensing device is inserted to come into close contact with an outer circumferential surface of the temperature sensing device. The temperature sensing device may be spaced apart from both inner surfaces of the case surrounding the through hole. The case may be made of an insulating material.

Specific details of other embodiments are included in the detailed description and drawings. The effects of the present disclosure are not limited to the above-mentioned effects, and other effects that are not mentioned will be apparent to those skilled in the art upon reading the claims.

Advantages and features of the present disclosure, and a method for achieving them could be apparent with reference to the embodiments described in detail together with the accompanying drawings. However, the present disclosure is not limited to the embodiments disclosed, but may be implemented in a variety of different forms, the embodiments are provided to only complete the present disclosure, and to allow a person of ordinary skill in the technical field to which the present disclosure belongs to understand the scope of the disclosure, and the present disclosure is only defined by the scope of the claims. The same reference numerals will be used to refer to the same or similar elements throughout the present disclosure.

Spatially relative terms such as "below", "beneath", "lower", "above", "upper", or the like, can be used to easily describe the correlation between one component and other components, as shown in the drawing. Spatially relative terms should be understood as terms including different directions of components in use or operation in addition to the direction shown in the drawings. For example, when inverting elements shown in a drawing, an element described as "below" or "beneath" of another element will be placed "above" the other element. Accordingly, the exemplary term "below" may encompass both directions below and above. An element may be oriented in other directions as well, and thus spatially relative terms may be interpreted according to the orientation.

The terms used in the present disclosure are used to describe specific embodiments and are not intended to limit the present disclosure. In the present disclosure, the terms of a singular form may include plurals form unless otherwise specified. As used in the present disclosure, the terms "comprises" and/or "comprising" specify the presence of stated components, steps, and/or operations, but do not exclude the presence or addition of one or more other components, steps and/or operations.

Unless otherwise defined, all terms (including technical and scientific terms) used in the present disclosure are intended to have the meanings commonly understood by those of ordinary skill in the art to which the present disclosure belongs. In addition, terms such as those defined in commonly used dictionaries should not be interpreted in an idealized or overly formal sense unless expressly defined otherwise.

In the drawings, the thickness or size of each element is exaggerated, omitted, or schematically illustrated for convenience and clarity of description. Furthermore, the size and area of each element do not fully reflect the actual size or area.

The present disclosure may be described based on a spatial Cartesian coordinate system of up and down (vertical), right and left, and front and rear directions that are orthogonal to each other shown in FIGS. 1 to 6. Each axial direction (up-down direction, right-left direction, front-rear direction) means both directions in which each axis extends. The up direction and the down direction means one and the other of the directions in which the vertical axis (e.g., y) extends, respectively. The right direction and the left direction means one and the other of the directions in which a horizontal (e.g., x) axis extends, respectively. The front direction and the rear direction means one and the other of the directions in which another horizontal or front and rear axis (e.g., z) extends, respectively.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a heat exchanger including:

a first cooling coil arranged along a first plane that is inclined;

a second cooling coil arranged along a second plane and is inclined, wherein refrigerant flows through the first and second cooling coils;

an inlet formed between a lower end of the first cooling coil and a lower end of the second cooling coil through which air passes; and a plate extending between the first and second cooling coils, the plate having a first hole;

a first air duct through which air introduced to the inlet flows;

a second air duct through which air passing through the heat exchanger flows;

a fan configured to guide air through the heat exchanger;

a temperature sensor configured to be inserted through the first hole to sense a temperature of the air introduced into the heat exchange; and a case provided between the first cooling coil and the second cooling coil, the case having a passage through which air flows wherein the temperature sensor is configured to be inserted through the case and at least partially provided in the passage.

2. The air conditioner of claim 1, wherein the first hole is formed on a lower portion of the plate to be spaced apart from the first cooling coil and the second cooling coil.

3. The air conditioner of claim 1, wherein the heat exchanger further includes a first bushing provided in the first hole, the first bushing being configured to maintain a position of the temperature sensor in the first hole.

4. The air conditioner of claim 1, wherein the case is coupled to the plate.

5. The air conditioner of claim 4, wherein the plate is formed with at least one second hole, and the case is formed with at least one hook configured to engage with the at least one second hole to secure the case to the plate.

6. The air conditioner of claim 5, wherein the case includes a support provided in the passage and configured to support the temperature sensor at an upper side and a lower side of the temperature sensor.

7. The air conditioner of claim 1, wherein at least one leg extends from a lower surface of the case.

8. The air conditioner of claim 7, wherein the at least one leg includes a plurality of legs spaced apart from each other on the lower surface of the case, and the lower surface includes an opening communicating with the passage such that air is configured to flow between the plurality of the legs, into the opening, and through the passage.

9. The air conditioner of claim 1, wherein a rear surface of the case includes a third hole through which the temperature sensor is configured to be inserted, and a second bushing is provided in the third hole, the second bushing being configured to maintain a position of the temperature sensor in the third hole.

10. The air conditioner of claim 1, wherein the temperature sensor is provided in the passage of the case and spaced apart from an inner surface of the case.

11. The air conditioner of claim 1, wherein the case is made of an insulating material.

12. The air conditioner of claim 1, wherein the first and second planes are inclined toward each other, and side edges of the plate are inclined such that the plate fits between the first and second cooling coils.

13. The air conditioner of claim 1, further comprising a gas furnace provided under the heat exchanger and configured to provide hot air.

14. An air conditioner, comprising:

an A-coil heat exchanger having an A-shaped plate and an inlet formed at a bottom rough which air passes, the plate having a first hole;

a first air duct through which air introduced to the inlet flows;

a second air duct through which air passing through the heat exchanger flows;

a fan configured to guide air through the heat exchanger;

a temperature sensor configured to be inserted through the first hole to sense a temperature of the air introduced into the heat exchanger; and a sensor support provided inside of the A-coil heat exchanger, the sensor support having a passage through which air flows, wherein the temperature sensor is configured to be inserted through the sensor support and at least partially provided in the passage.

15. The air conditioner of claim 14, wherein the sensor support is formed with at least one hook, and the plate is formed with at least one second hole configured to receive the at least one hook.

16. The air conditioner of claim 14, wherein the sensor support includes a third hole through which the temperature sensor is configured to be inserted, the third hole configured to align with the first hole when the support is coupled to the plate.

17. The air conditioner of claim 14, further comprising a compressor, a condenser, and an expansion valve which are controlled based on a sensing by the temperature sensor.

18. A heat-exchanger, comprising:

a first cooling coil arranged along a first plane that is inclined;

a second cooling coil arranged along a second plane and is inclined, wherein refrigerant flows through the first and second cooling coils;

an inlet formed between a lower end of the first cooling coil and a lower end of the second cooling coil through which air passes;

a plate extending between the first and second cooling coils, the plate having a first hole;

a case provided between the first and second cooling coils and configured to couple to the plate, the case having a passage and a second hole configured to align with the first hole when the case is coupled to the plate; wherein the passage is formed through the case such that air introduced through the inlet is configured to flow through the passage; and a temperature sensor configured to be inserted through the first and second holes to sense a temperature of air flowing in the passage.

19. An air conditioner including the heat exchanger of claim 18.

* * * * *